US005873531A

United States Patent [19]

Wang

[11] Patent Number: 5,873,531

[45] Date of Patent: Feb. 23, 1999

[54] WATER SPRAY GUN HAVING AN IMPROVED SPRINKLING CAP FOR GARDEN HOSE

[75] Inventor: King-Yuan Wang, Changhua Hsien, Taiwan

[73] Assignee: Yuan Mei Corp., Changhua Hsien, Taiwan

[21] Appl. No.: 865,876

[22] Filed: May 30, 1997

[51] Int. Cl.[6] ..... B05B 1/12

[52] U.S. Cl. ..... 239/394; 239/526

[58] Field of Search ..... 239/394, 393, 239/396, 391, 526

[56] References Cited

U.S. PATENT DOCUMENTS

| | | | |
|---|---|---|---|
| 4,534,512 | 8/1985 | Chew et al. | 239/394 |
| 4,666,085 | 5/1987 | Lian | 239/394 |
| 5,501,400 | 3/1996 | Kuo | 239/394 |
| 5,566,886 | 10/1996 | Wang | 239/394 |

*Primary Examiner*—Kevin Weldon

*Attorney, Agent, or Firm*—Browdy and Neimark

[57] ABSTRACT

A water spray gun having an improved sprinkler head structure for use on a garden hose. The sprinkler head has a head body and a sprinkling cap and a bottom plate that are joined together by way of ultrasonic welding art. The sprinkling cap is rotatably mounted onto the head body having a water outlet. The sprinkling cap has a peripherally ring area having a plurality of sprinkling pores and a number of water discharge holes of various geometric shapes. Each water discharge hole of the sprinkling cap has a tubular extension and the tubular extensions are bridged by vertical wall sections and an S-shaped wall section to define a closed area. The bottom plate has a plurality of circular holes ending with protruded flanges that defines a closed area in correspondence to that of the sprinkling cap. Or the bottom plate and inside and outside of the closed are are disposed a small rhombic opening in communication with a circular hole of the sprinkling cap and a large rhombic opening in communication with the ring area respective that can be registered with the water outlet of the head body separately or simultaneously so that water can be discharged via the discharge hole or the ring area of the sprinkling cap separately or together.

3 Claims, 6 Drawing Sheets

WATER SPRAY GUN HAVING AN IMPROVED SPRINKLING CAP FOR GARDEN HOSE

BACKGROUND OF THE INVENTION

The present invention relates to a water spray gun having an improved sprinkler head structure for use on a garden hose. The sprinkler head has a head body and a sprinkling cap and a bottom plate that are joined together by way of ultrasonic welding art. The sprinkling cap is rotatably mounted onto the head body. The head body has a water outlet and a spring receiving hole in which a spring biased locking pin is housed. The locking pin can be selectively engaged with one of a number of retaining cavities defined on one side of the bottom plate. The sprinkling cap has a peripheral ring area having a plurality of sprinkling pores and a number of water discharge holes of various geometric shapes. Each water discharge hole of the sprinkling cap has a tubular extension and the tubular extensions are bridged by vertical wall sections and an S-shaped wall section to define a closed area. The bottom plate has a plurality of circular holes ending with protruded flanges that defines a closed area in correspondence to that of the sprinkling cap. On the bottom plate and inside and outside of the closed area are disposed a small rhombic opening in communication with a circular hole of the sprinkling cap and a large rhombic opening in communication with the ring area respectively that can be registered with the water outlet of the head body separately of simultaneously so that water can be discharged via the discharge hole or the ring area of the sprinkling cap separately or together.

In general, conventional water spray guns of various kinds for use on a garden hose have a sprinkling cap and a bottom plate bound together by the ultrasonic welding and an head body. The prior art sprinkling cap rotatably mounted onto the head body has a number of differently shaped discharge holes and water flowing through a water outlet of the head body can only be discharged via one of the discharge holes without multiple variations.

OBJECT AND SUMMARY OF THE INVENTION

Therefore, the primary object of the present invention is to provide a water spray gun having an improved sprinkler head including a sprinkling cap bound with a bottom plate and a head body. The sprinkling cap with the bottom plate is rotatably mounted onto the head body having a water outlet. The sprinkling cap has a ring area equipped with a plurality of sprinkling pores and a number of discharge holes of various geometric shapes. The discharge holes have a tubular extension respectively and the holes are bridges by vertical wall sections and an S-shaped wall section, defining a closed area in which a discharge hole is disposed and the ring area of the sprinkling cap is located outside the closed area. The bottom plate having a number of circular holes in alignment with those discharge holes of the sprinkling cap is also provided with a closed area defined by pretruded flanges and an S-shaped flange bridging the circular holes. A small and large rhombic opening are located inside and outside the closed area respectively whereby when the sprinkling cap is rotated to make the small rhombic opening registered with the water outlet, water is discharged via the discharge hole on the sprinkling cap; and water is discharged via the ring area of the cap when the large rhombic opening is in registration with the water outlet; or water can be discharged simultaneously via the discharge hole and the ring area at the same time when both the small and large rhombic openings are in registration with the water outlet of the head body.

DETAILED DESCRIPTION OF THE PREFERRED EMBODIMENTS

Figure 1:
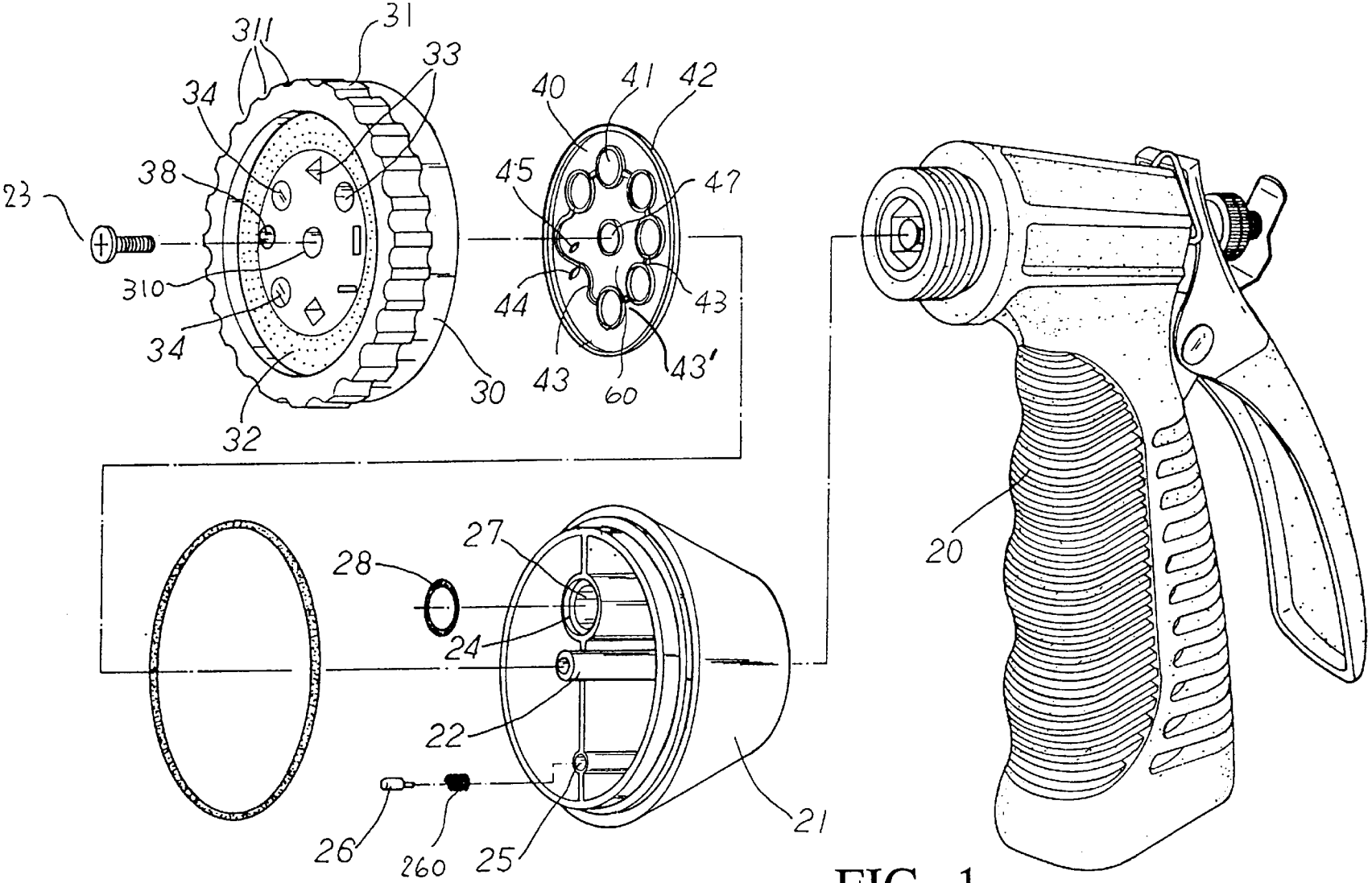
FIG. 1 is a perspective diagram showing the exploded components of the present invention.
Figure 3:
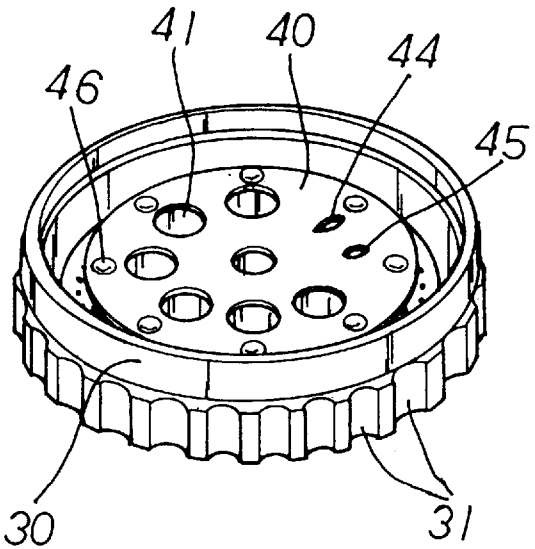
FIG. 3 is a perspective diagram showing the assembly of the sprinkler cap with the inner side thereof exposed.

Referring to FIG. 1, the water spray gun 20 of the present invention has an improved sprinkler head for use on a garden hose. The sprinkler head of the water spray gun 20 is made up of an improved sprinkling cap 30 and a head body 21. The sprinkling cap 30 has a circular bottom plate 40 secured thereto by way of ultrasonic welding art.

The head body 21 defined in a flat end conic shape has a central fixing pole 22 and a water outlet 24 disposed right above the fixing pole 22 and a spring receiving hole 25 located linearly a distance thereunder. The sprinkling cap 30 and the bottom plate 48 both have a central hole 310 and 47 respectively so as to permit a screw 23 to pass therethrough and engage with said central fixing pole 22 for removably fixing the sprinkling cap 30 along with the bottom plate 40 to the head body 21.

The water outlet 24 has a countersink 27 at the frontmost end thereof for housing an O-shaped ring 28. The sprinkling cap 30 has a peripheral gripping flange 31 provided with a plurality of equally spaced recessed 311.

Figure 2:
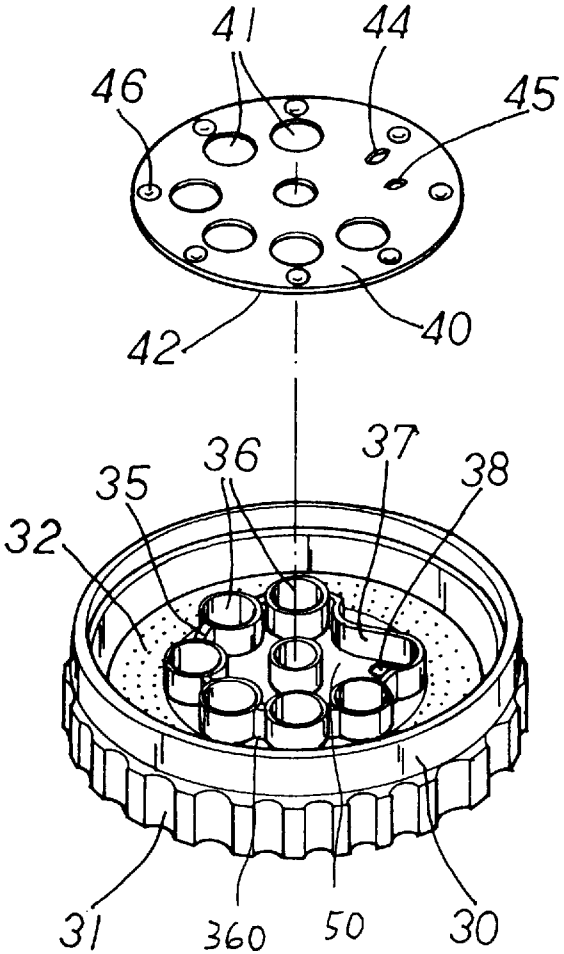
FIG. 2 is a perspective diagram of the sprinkler cap whose inner structure is shown.
Figure 4:
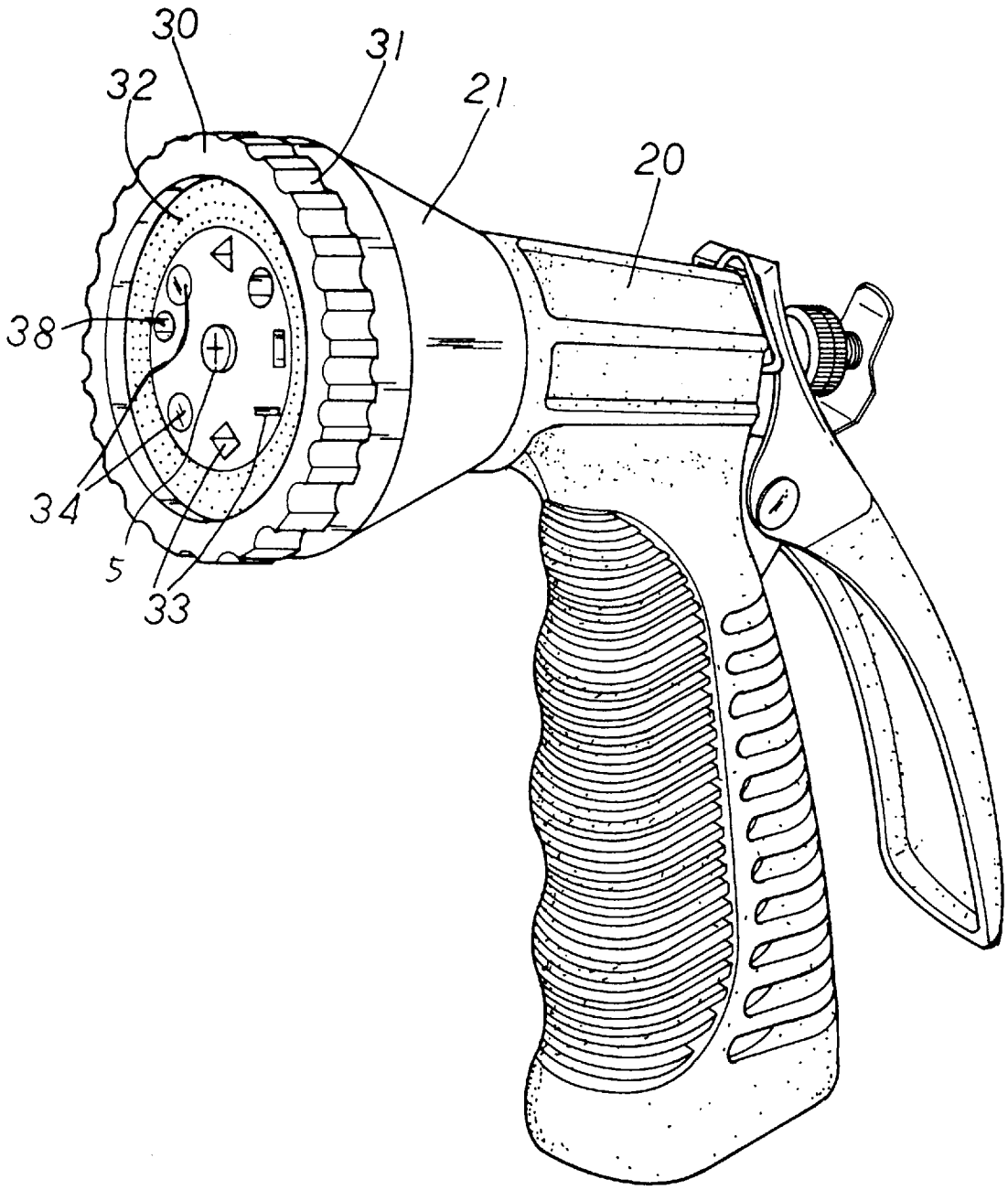
FIG. 4 is a perspective diagram showing the whole sprinkler head of the present invention.
Figure 5A:
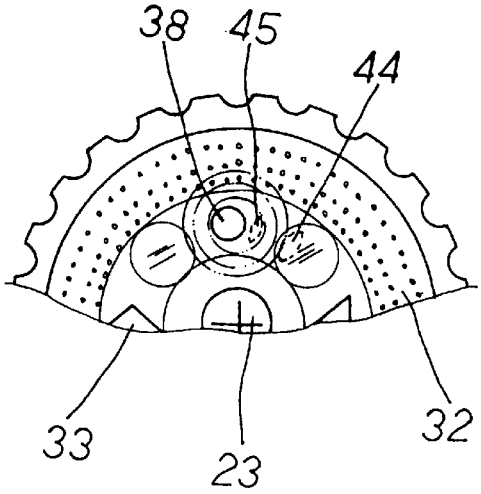
FIG. 5A is a partial diagram showing the small rhombic opening of the bottom plate being placed in alignment with a circular hole on the sprinkling cap.
Figure 5B:
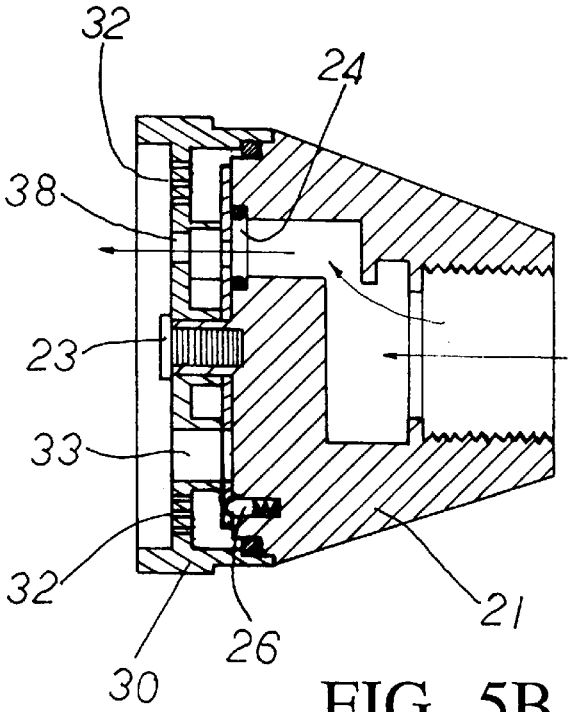
FIG. 5B is a sectional diagram according to FIG. 54A; showing water being discharged via a circular hole of the sprinkling cap.
Figure 6A:
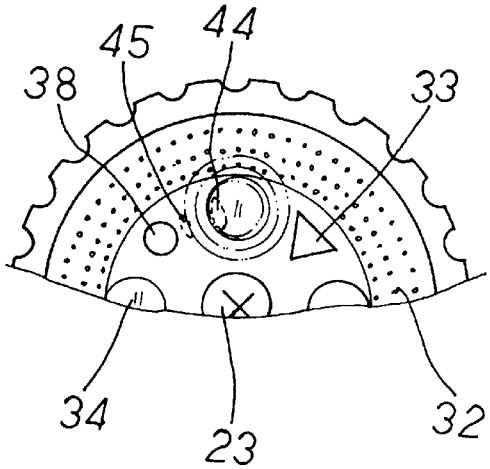
FIG. 6A is a partial diagram showing the large rhombic opening of the bottom plate being placed in alignment with a blocked area of the sprinkling cap.
Figure 6B:
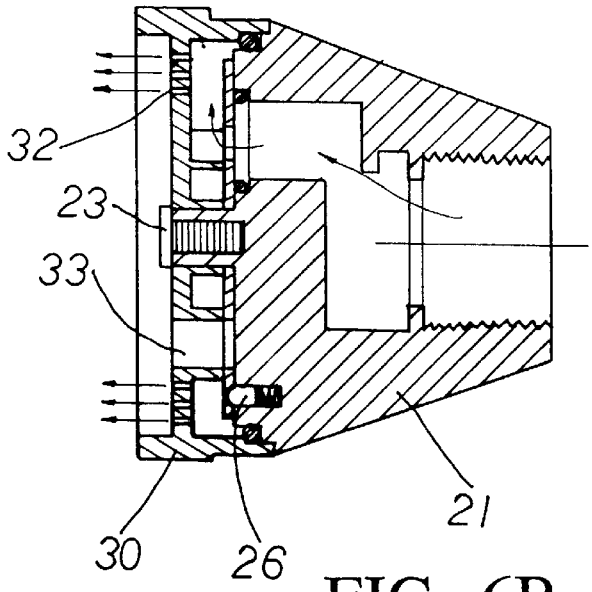
FIG. 6B is a sectional diagram according to FIG. 6A; showing water being discharged via a ring area having a plurality of sprinkling pores to FIG. 6A.
Figure 7A:
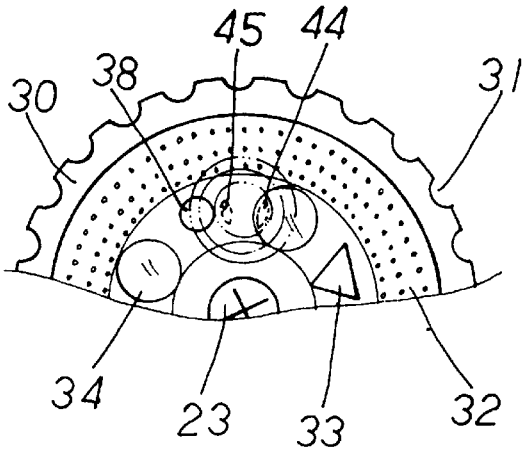
FIG. 7A is a partial diagram according to FIG 7A; showing the small and large rhombic holes both being located in registration with a water outlet of the head body.
Figure 7B:
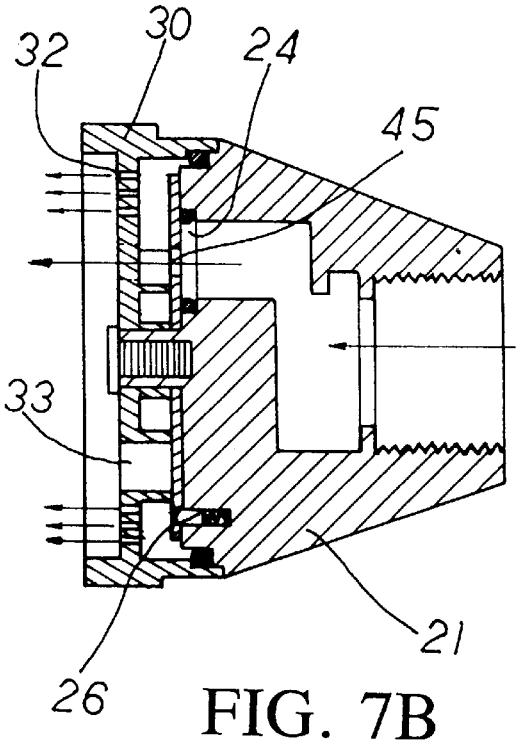
FIG. 7B is a sectional diagram according to FIG. 7A; showing water being discharge via both the ring area and the circular hole of the sprinkling cap.

A ring area 32 having a plurality of sprinkling pores is disposed next to the inner side of the gripping flange 31. A plurality of water discharge holes 33 of various geometric shapes are defined adjacent the inner periphery of the ring area 32 defined in abutment to the gripping flange 31. As shown in FIG. 2, each discharge hole 33 has a tubular extension 36 extending toward the head body 21.

The bottom plate 48 has a plurality of circular holes 41 peripherally defined in conformance to the tubular extensoins 36 of the sprinkling cap 30 with two of the holes 41 joined by an S-shaped flange 43. Each circular holes 41 of the bottom plate 40 has a protruded flange 43 abutting against one end of each tubular extensions 36 and welded together by ultrasonic waves.

On the other side of the bottom plate 40 and adjacent each circular hole 41 thereof is disposed a retaining cavity 46 with which a locking pin 26 actuated by the spring 260 housed in the spring receiving hole 25 is engaged to lock the rotatable sprinkling cap 31 in position after one of the circular holes 41 of the bottom plate 40 is adjusted into registration with the water outlet 24 of the head body 21 so that water is discharged from one of the water discharge holes 33 having various geometric shapes with the help of the O-shaped sealing ring 28.

The water spray gun of the present invention is characterized by the following features. The sprinkling cap 31 has two extra circular blocking areas 34 in addition to 6 differently shaped water discharge holes including a circular, square, triangular, horizontally oriented and a vertically oriented rectangular hole, and a closed circular area, each having a tubular extension 36 in association with the water discharge holes 33 of the sprinkling cap 31. The tubular extensions 36 are bridged together by a vertical wall section 360 except two of said tubular extensions 36 which are bridged by an S-shaped vertical wall section 37 both sections 360 and 37 defining a closed area 50. The S-shaped vertical wall section 37 is positioned in correspondence to the circular hole 32 and one of the blocked circular areas 34 of the sprinkling cap 31. The circular hole 38 is defined in the closed area 50 adjacent to the S-shaped vertical wall section 37. On the bottom plate 40 are disposed a small rhombic opening 45 (not disclosed in all the prior art FIGS.) located in the inner side of a closed are 60 defined by the protruded flanges 43 defined among the circular holes 41 and an S-shaped protruded flange 43 defined between two holes and a large rhombic opening 44 located on the outer side of the closed area 60 in communication with the outer side of the S-shaped vertical wall section 37. The ring area 32 of the sprinkling cap 31 has a plurality of small sprinkling pores. The small rhombic opening 45 is placed in alignment with the circular hole 38 located on the inner side of the closed area 50 and adjacent the S-shaped vertical wall section 37 of the sprinkling cap 30 so that water can flow through the small rhombic opening 45 into the closed area 50 of the sprinkling cap 30 and be discharged via the circular hole 38 of the sprinkling cap 38 in a strong stream when the small rhombic opening 45 communicates with the water outlet 24; and water can be discharged via the sprinkling pores of the ring area 32 of the sprinkling cap 30 when the large rhombic opening 44 in communication with the outer side of the closed area 50 is in registration with water outlet 24 whereby water can be discharged in 3 additional ways, i.e., water can be discharged via the ring area 32 or via the circular hole 38 or via the ring area 32 and the circular discharge hole 38 simultaneously when both the small and large rhombic openings 44, 45 are located in registration with the water outlet 24 of the head body 21.

Figure 8:
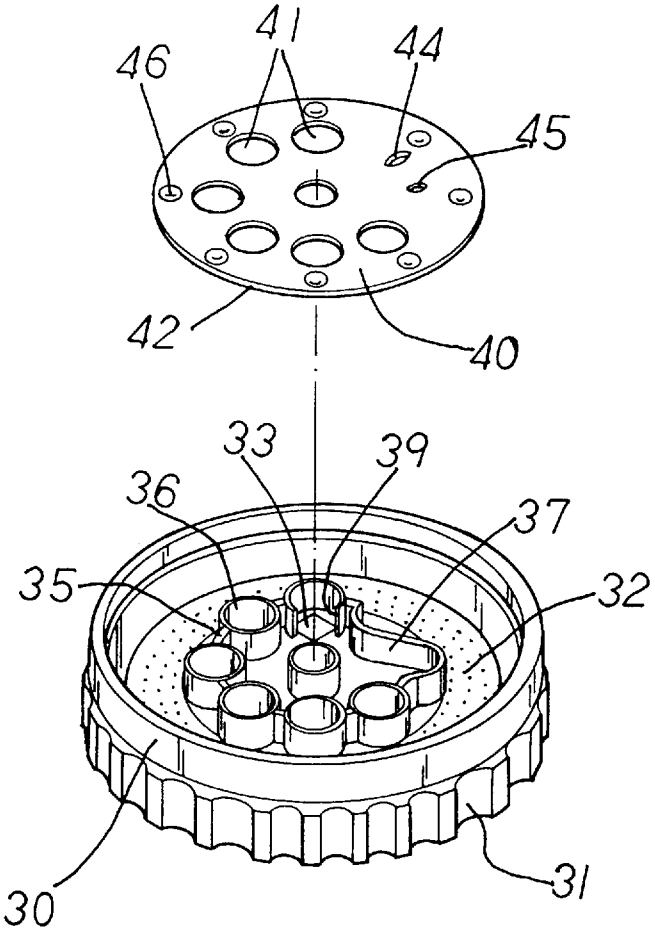
FIG. 8 is a diagram showing a second embodiment of the present invention.

Referring to FIG. 8, another embodiment of the water spray gun of the present invention is shown wherein the circular hole 38 located adjacent the S-shaped vertical wall section 37 and in the inner side of the closed area 50 on the spring cap 30 is blocked and one of the tubular extensions is provided with an opening whereby water flowing into the closed area via the small rhombic opening 45 can be discharged via one of the water discharge holes 33.

Figure 9:
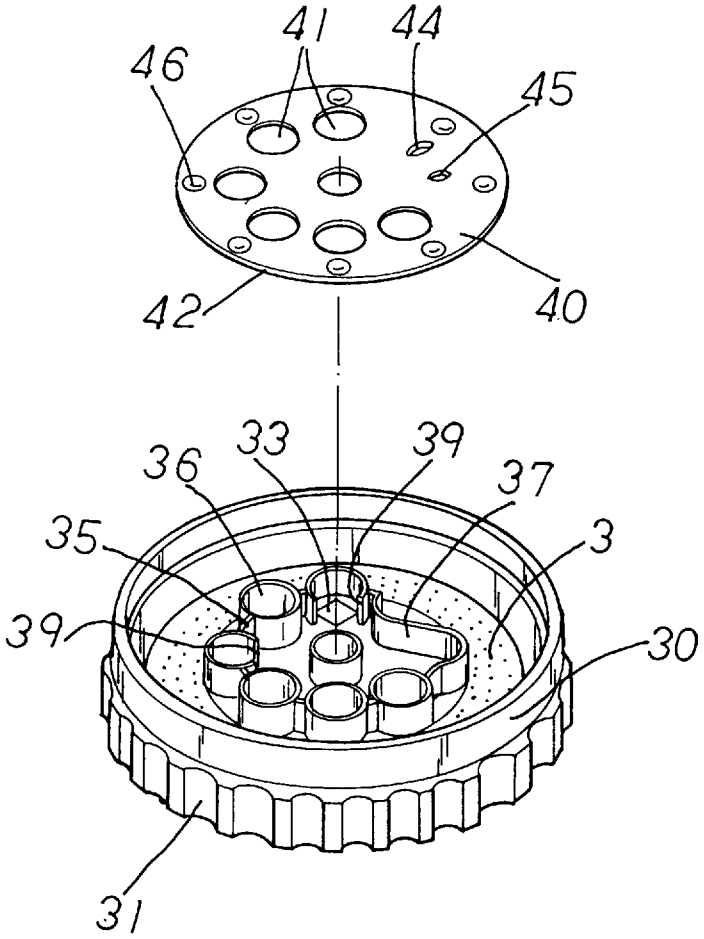
FIG. 9 is a diagram showing a third embodiment of the present invention.

Referring further to FIG. 9, a third embodiment of the water spray gun of the present invention is given wherein the circular hole 38 located adjacent the S-shaped vertical wall section 37 and in the inner side of the closed area 50 on the sprinkling cap 30 is blocked and the alternating tubular extensions 36 are provided with an opening 39 whereby water flowing into the closed area 58 via the small rhombic opening 45 can be discharged via the water discharge being alternatively.

I claim:

1. A water spray gun having an improved sprinkling cap for use on a garden hose comprising a spray gun and a sprinkler head made up of of a hollow frustoconical head body and a sprinkling cap having a circular bottom plate secured thereto by ultrasonic welding;

a base of said hollow frustoconical head body having an open end, a central fixing pole, a water outlet disposed above said fixing pole and a spring receiving hole all being engaged in said hollow frustoconical head body;

said sprinkling cap and said bottom plate both having a central hole so as to permit a screw to pass therethrough and engage with said central fixing pole for removably fixing said sprinkling cap along with said bottom plate to said head body;

said water outlet having a countersink at the front most end thereof for housing an O-shaped ring;

said sprinkling cap having a peripheral gripping flange provided with a plurality of spaced recesses and a ring area having a plurality of sprinkling pores;

a plurality of water discharge holes of various geometric shapes being peripherally defined adjacent the inner side of said ring, which is in abutment to said gripping flange;

each said discharge hole having a tubular extension extending toward said head body;

said bottom plate having a plurality of circular holes peripherally corresponding to said tubular extensions of said sprinkling cap with two of said holes joined by an S-shaped flange;

each said circular holes of said bottom plate having a protruded flange which abuts against one end of each said tubular extension and engaged together by ultrasonic welding;

a retaining cavity being disposed on the other side of said bottom plate and adjacent to each said circular hole thereof, a locking pin actuated by a spring housed in said spring receiving hole respectively engageable in each said retaining cavity to lock said rotatable sprinkling cap in position after one of said circular holes of said bottom plate is adjusted to communicate with said water outlet of said head body so that water is discharged from one of said water discharge holes having various geometric shapes;

wherein said sprinkling cap has two extra circular blocking areas in addition to a plurality of differently shaped water discharged holes; said tubular extensions corresponding to said water discharge holes of said sprinkling cap being bridges together by a vertical wall section and two of said tubular extensions being bridges by an S-shaped vertical wall section as as to define a closed area; said S-shaped vertical wall section being positioned in correspondence to said circular hole and said closed circular area of said sprinkling cap; said circular hole being defined in said closed area adjacent to said S-shaped vertical wall section; said bottom plate having a small rhombic opening located in an inner side of a closed area defined by each protruded flanges defined among said circular holes and an S-shaped protruded flanges between two holes and a large rhombic opening located on an outer side of said closed area in communication with said outer side of said S-shaped vertical wall and said ring area having a plurality of small sprinkling pores on said sprinkling cap; said small rhombic opening being in alignment with said circular hole located on said inner side of and adjacent to said S-shaped vertical wall of said sprinkling cap so that water can flow through said small rhombic opening into said closed area of said sprinkling cap and be discharged via said circular hole of said sprinkling cap in a strong stream when said small rhombic opening comes into alignment with said water outlet whereby water can be discharged in three additional ways, (i.e., water can be discharged) via said ring area, via said circular hole or via said ring area and said circular discharge hole simultaneously when both said small and large rhombic openings are both communicate with said water outlet of said head body.

2. The water spray gun as claimed in claim 1 wherein said circular hole located adjacent said S-shaped vertical wall and in the inner side of said closed area on said sprinkling cap is blocked and one of said tubular extensions is provided with an opening whereby water flowing into said closed area via said small rhombic opening can be discharged via one of said water discharge holes.

3. The water spray gun as claimed in claim 1 wherein said circular hole located adjacent said S-shaped vertical wall and in the inner side of said closed area on said sprinkling can is blocked and said alternating tubular extensions are provided with an opening whereby water flowing into said closed area via said small rhombic opening can be discharged via said water discharge holes alternatively.

* * * * *